US006199978B1

(12) United States Patent
Ishii et al.

(10) Patent No.: US 6,199,978 B1
(45) Date of Patent: Mar. 13, 2001

(54) HOT MELT INK JET PRINTER

(75) Inventors: Makoto Ishii, Nagoya; Shunji Murai, Tokai, both of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/102,377

(22) Filed: Jun. 23, 1998

(30) Foreign Application Priority Data

Jul. 18, 1997 (JP) ..... 9-193746

(51) Int. Cl.[7] ..... B41J 2/175; B41J 29/13
(52) U.S. Cl. ..... 347/88; 347/108
(58) Field of Search ..... 347/37, 104, 88, 347/99, 108; 400/472; 312/208.3, 215, 292

(56) References Cited

U.S. PATENT DOCUMENTS 5,105,210 * 4/1992 Hirano et al. ..... 347/108
5,341,164 * 8/1994 Miyawa et al. ..... 347/88
5,442,387 * 8/1995 Loofbourow et al. ..... 347/88
5,909,226 * 6/1999 Takeda ..... 347/3
6,053,608 * 4/2000 Ishii et al. ..... 347/88

* cited by examiner

*Primary Examiner*—N. Le
*Assistant Examiner*—Judy Nguyen
(74) *Attorney, Agent, or Firm*—Oliff & Berridge, PLC

(57) ABSTRACT

A hot melt ink jet printer includes a central opening provided on its main frame casing that can be opened and closed by one motion. An ink pellet setting opening to allow ink pellets of different colors to be supplemented separately is provided on the top surface of the main frame casing. An inner cover including an ink case that covers over the ink pellet supplementing opening and a side cover body constructed to be joined to one side of the ink case is installed, but allowing for vertical pivotal motion, to close the central opening.

20 Claims, 9 Drawing Sheets

HOT MELT INK JET PRINTER

BACKGROUND OF THE INVENTION

1. Field of Invention

The present invention relates to a hot melt ink jet printer, and in full detail, a case structure of an ink supplying device of that printer.

2. Description of Related Art

Conventionally, hot melt ink jet printers include a recording head having a nozzle head with manifold nozzles, ink melting units with heaters, and hoppers which hold ink pellets that are solid at normal temperature was mounted on a carriage. The printers were constructed such that character or graphic images were printed on the surface of paper by letting hot melt ink liquid gush out from the nozzle head, while moving the carriage in a direction (of its primary scan) perpendicular to the paper feed direction.

By the way, these printers had a problem of deterioration in the quality of hot melt ink, because, when an operator touches an ink pellet directly by hand when supplementing the ink, the dirt or sebum, if present on his or her hand, might adhere to the ink pellet. The applicant for the patent of this invention, as specified in U.S. patent application Ser. No. 08/880,411 (incorporated herein by reference) already modified the structure of the conventional printer by installing an ink case, in which color ink pellets for various colors were previously stored separately per color, in an ink supplying section and integrating a top cover covering over the top of the ink case into the top surface of the main frame casing of the printer.

In this modification, if the ink ran short, it was supplemented to the recording head mounted on the carriage simply by moving the carriage to the ink supply position where the appropriate ink pellet in the ink case was pushed downward.

Meanwhile, various types of printers were designed to remove jammed paper easily by removing a cover section covering over the top of the carriage in the event that a paper jam occurred when images were printed on paper by the recording head.

As the above-mentioned U.S. patent application Ser. No. 08/880,411 stated, the ink case provided on the top of the printer was not removed from the main frame casing of the printer, which posed another problem that the limited opening area over the carriage made it difficult to remove jammed paper.

Even though the ink case was allowed to open and close or be removed, there was another problem that it was more troublesome to open and close or remove and reinstall the ink case in addition to opening and closing the cover as the work required to remove jammed paper.

The achievement in this invention has been made by the efforts to resolve the problems of the previous ink jet printer.

SUMMARY OF THE INVENTION

An object of the present invention is to provide a hot melt ink jet printer which allows the operator to open and close the opening on the top of the printer easily.

To accomplish this object, first, the present invention offers, according to one aspect of this invention, a hot melt ink jet printer constructed by mounting a recording head, which gushes out hot melt ink to the surface of a medium onto which images are printed, on a carriage, by assembling the carriage to be driven to scan in a direction perpendicular to the feed direction of the medium, and by locating an ink supplying section, which is to supply ink pellets to the recording head, on one end of the scan direction. In this printer, an opening area is provided on the top of the printer's main frame casing, and a lid covers the opening area. The opening area includes an ink case to store ink pellets, positioned over the ink supplying section and a cover body which is so constructed as to be joined to one side of the ink case.

According to another aspect of this invention, second, the present invention offers the hot melt ink jet printer according to the first aspect of this invention, wherein the lid is provided with vertically pivotable attachments to the main frame casing, a positioning element is provided for the main frame casing to be used when the opening area is closed, and a lock/release is provided for the main frame casing.

According to another aspect of this invention, third, the present invention offers the hot melt ink jet printer according to at least the second aspect of this invention, wherein an ink pellet supplementing opening is provided on the top of the ink case, a case cover covering over at least the ink pellet supplementing opening is attached, but allowing for pivotable motion to the ink case in a position opposite to the attachment for the main frame casing and the ink case, and a lock/release is provided for the case cover and the ink case.

According to another aspect of this invention, fourth, the present invention offers the hot melt ink jet printer according to at least the first or the third aspect of this invention, wherein the ink case is provided with ejection sections arranged at suitable intervals along the scan direction to eject ink pellets of different colors separately to hoppers on the carriage, and the ink case is located on the upper side of the main frame casing so the ejection sections will be placed in a lower position.

According to another aspect of this invention, fifth, the present invention offers the hot melt ink jet printer according to at least the first or the fourth aspect of this invention, wherein the lid is made of transparent or semitransparent material and formed as an integral construction.

As described above, this invention is beneficial in that, because the lid covering over the opening area includes an assembly of the ink case and the side cover body, the opening area can be exposed simply and at once by opening the lid when paper jam occurs during print operation, and thus it contributes to the improvement of the easiness to use of the printer.

Furthermore, because the lid is provided with vertically pivotable attachments to the main frame casing, the positioning element, and the lock/release, even a large lid can be positioned easily and the opening area closed tightly. Using the lock/release, the opening area can keep closed and the lid can be removed easily, which is another advantage.

Besides, the ink pellet supplementing opening is provided on the top of the ink case and the case cover covering over at least the ink pellet supplementing opening is attached pivotably to the ink case in a position opposite to the attachment for the main frame casing and the ink case. Therefore, even if the assembly of the ink case and the side cover body is opened while the user holds only the ink case section, the case cover will not be removed from the ink case and opened unintentionally, because the case cover opens in a direction opposite to the way in which the ink case opens.

Besides, because the case cover fits on the ink case via the lock/release, even if the ink case is opened widely with the case cover down, the case cover will not be removed from the ink case and opened unintentionally, which is advantageous.

Furthermore, the ink case is mounted on the main frame casing so that ink pellets can easily be moved by their weight to their ejection position. For color printers, selection of an ink pellet to be supplemented to a specific hopper can be made quite easily by simply moving the carriage along the scan direction appropriately, which is another advantage.

Finally, the lid can be made of transparent or semitransparent material and integrally constructed, which is advantageous in that the user can visually check the condition inside the opening area of the main frame casing from the outside easily.

BRIEF DESCRIPTION OF THE DRAWINGS

Preferred embodiments of the present invention will be described in detail with reference to the following figures wherein.

DETAILED DESCRIPTION OF PREFERRED EMBODIMENTS

Figure 1:
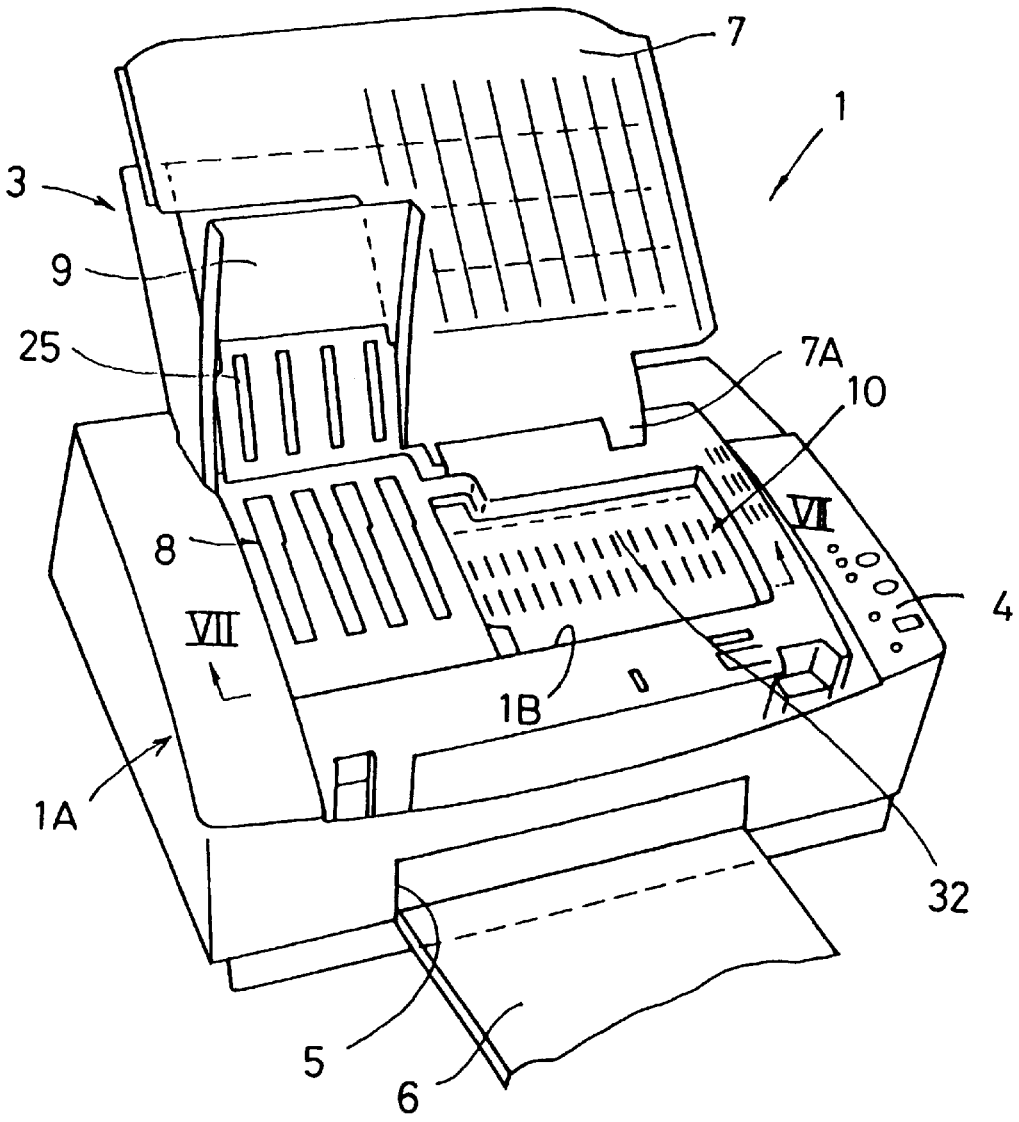
FIG. 1 is a perspective view of a printer according to the present invention.
Figure 2:
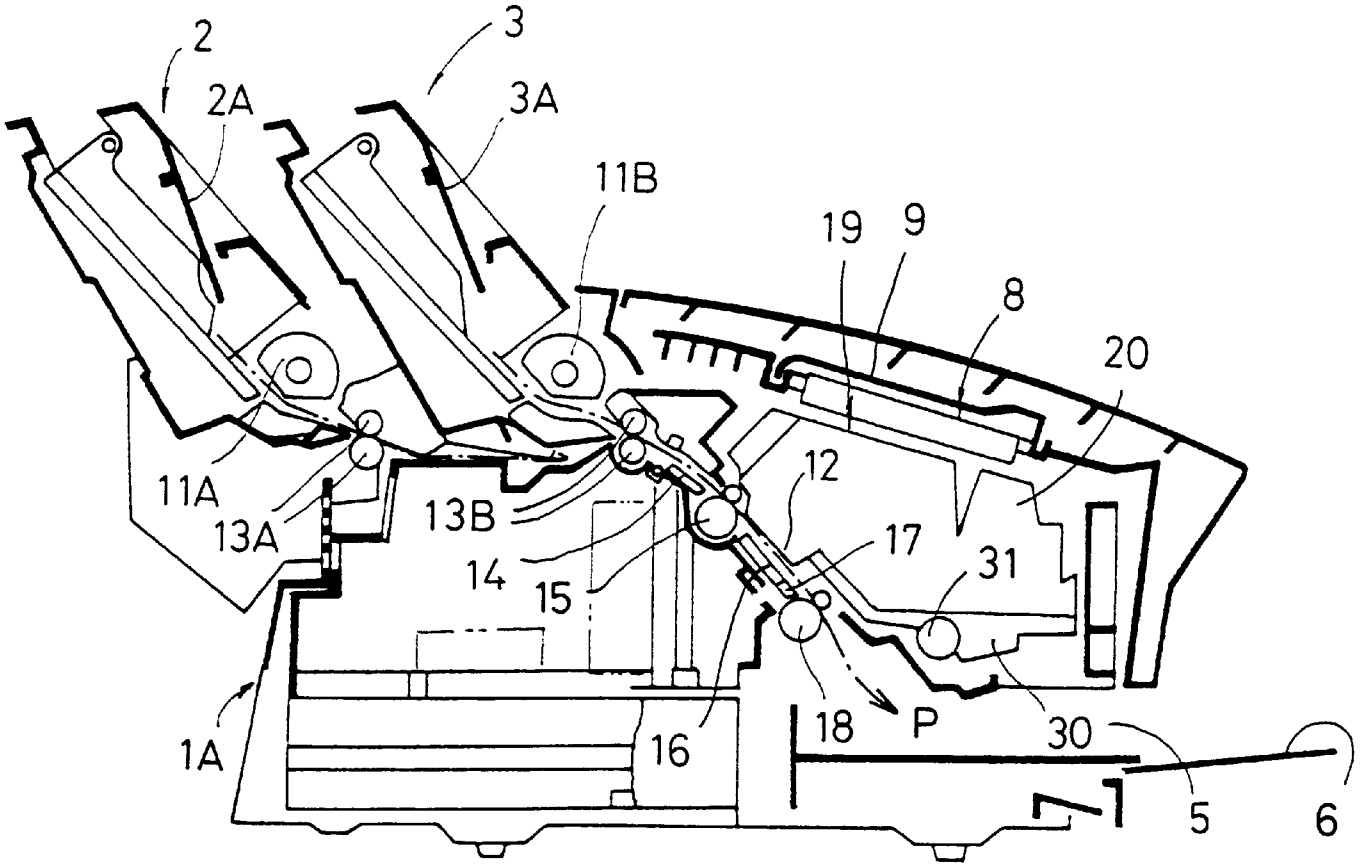
FIG. 2 is a cross section of the printer.
Figure 3:
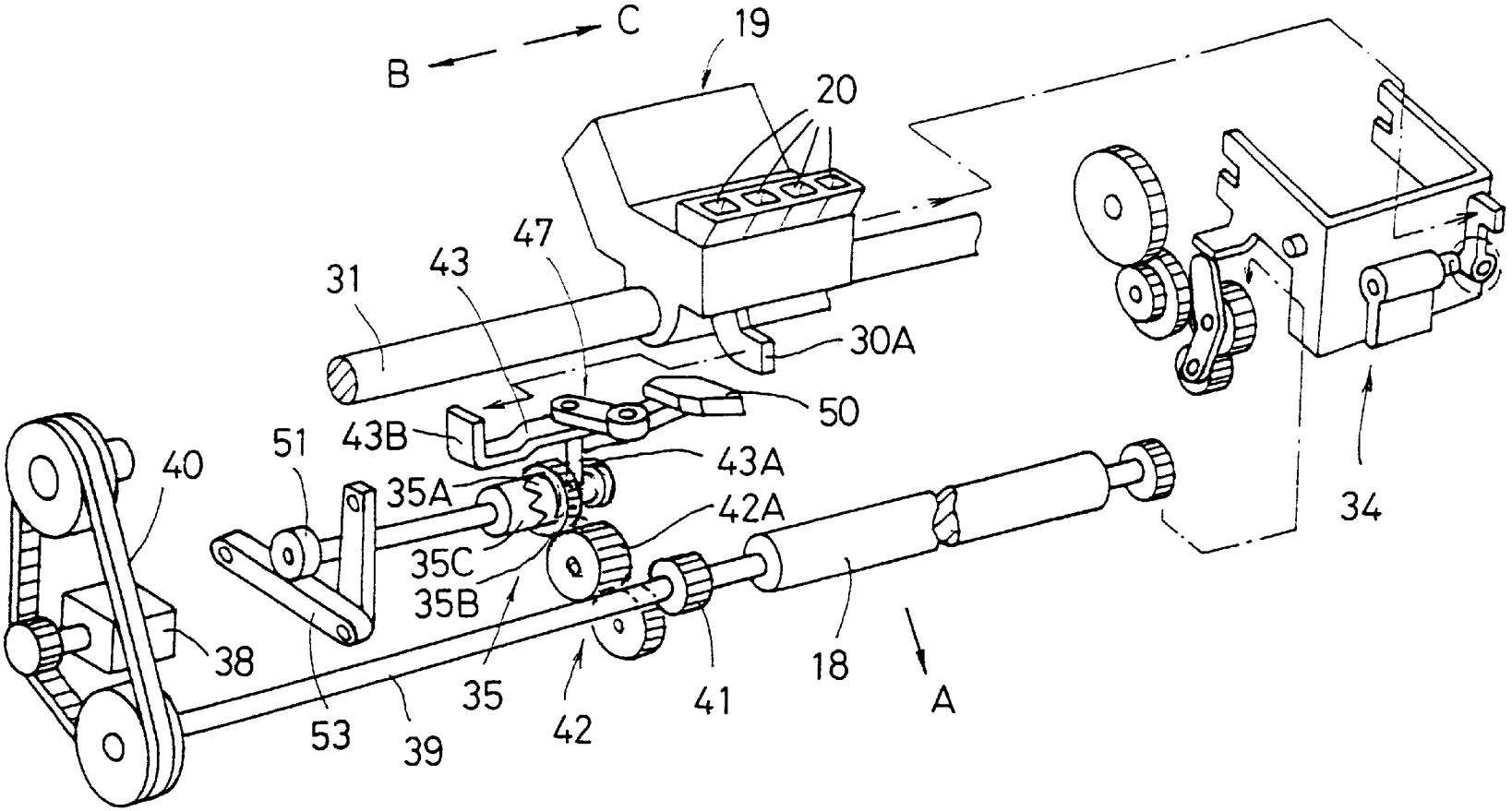
FIG. 3 is a schematic perspective view of the carriage and a clutch in the ink supplying section.
Figure 4:
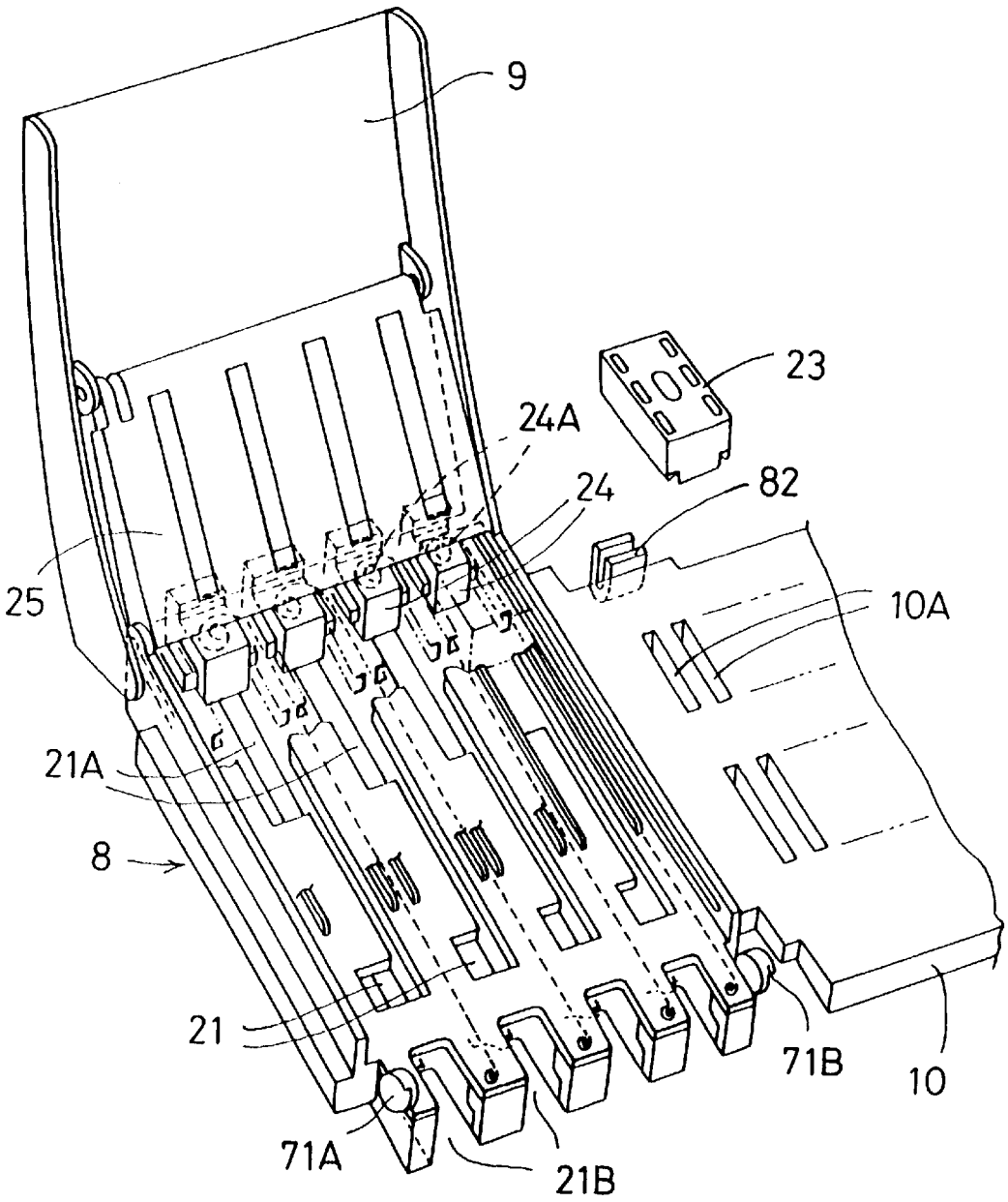
FIG. 4 is a perspective view of the ink case.
Figure 5:
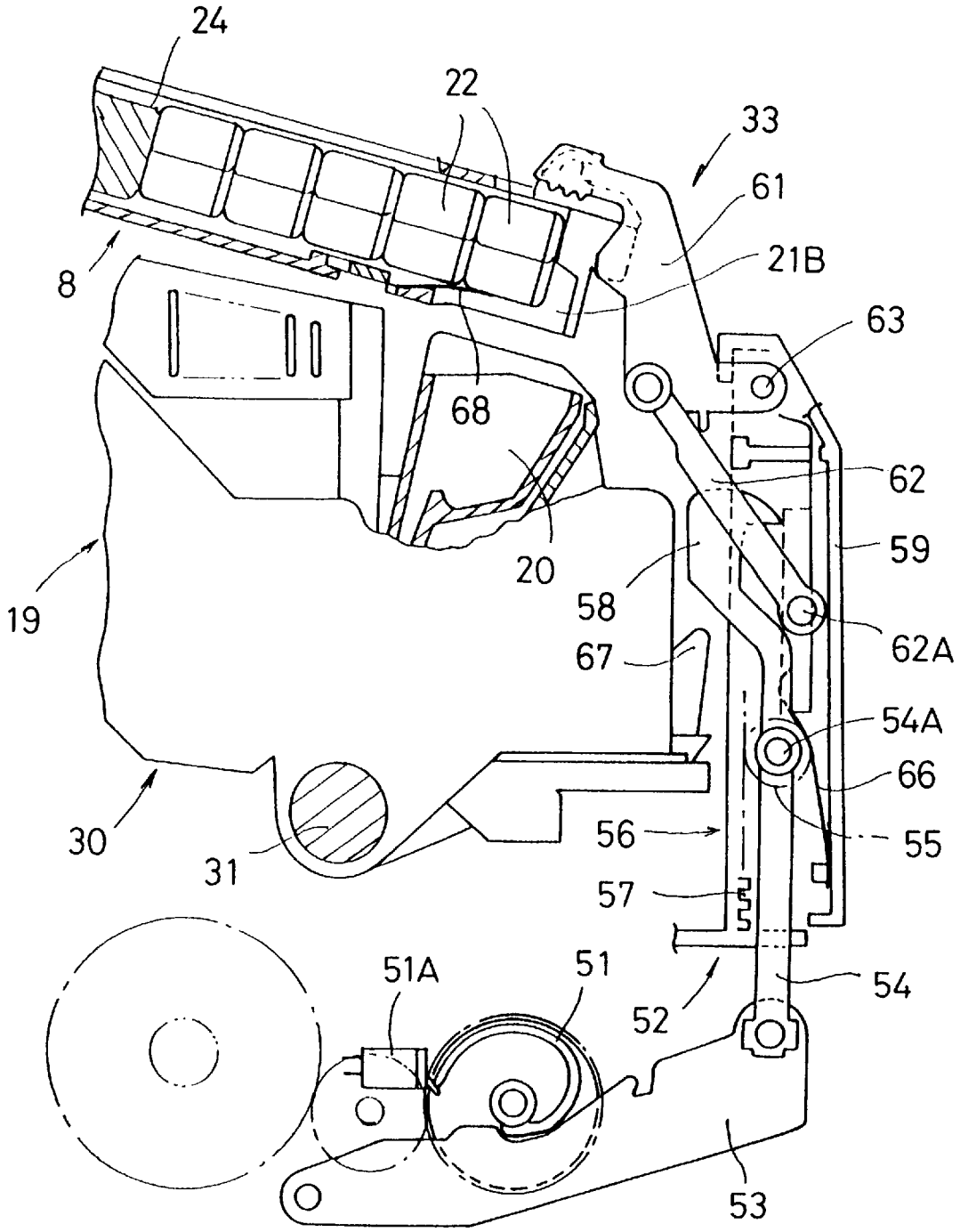
FIG. 5 is a side view of the ink supplying section and a pellet ejecting mechanism.
Figure 6:
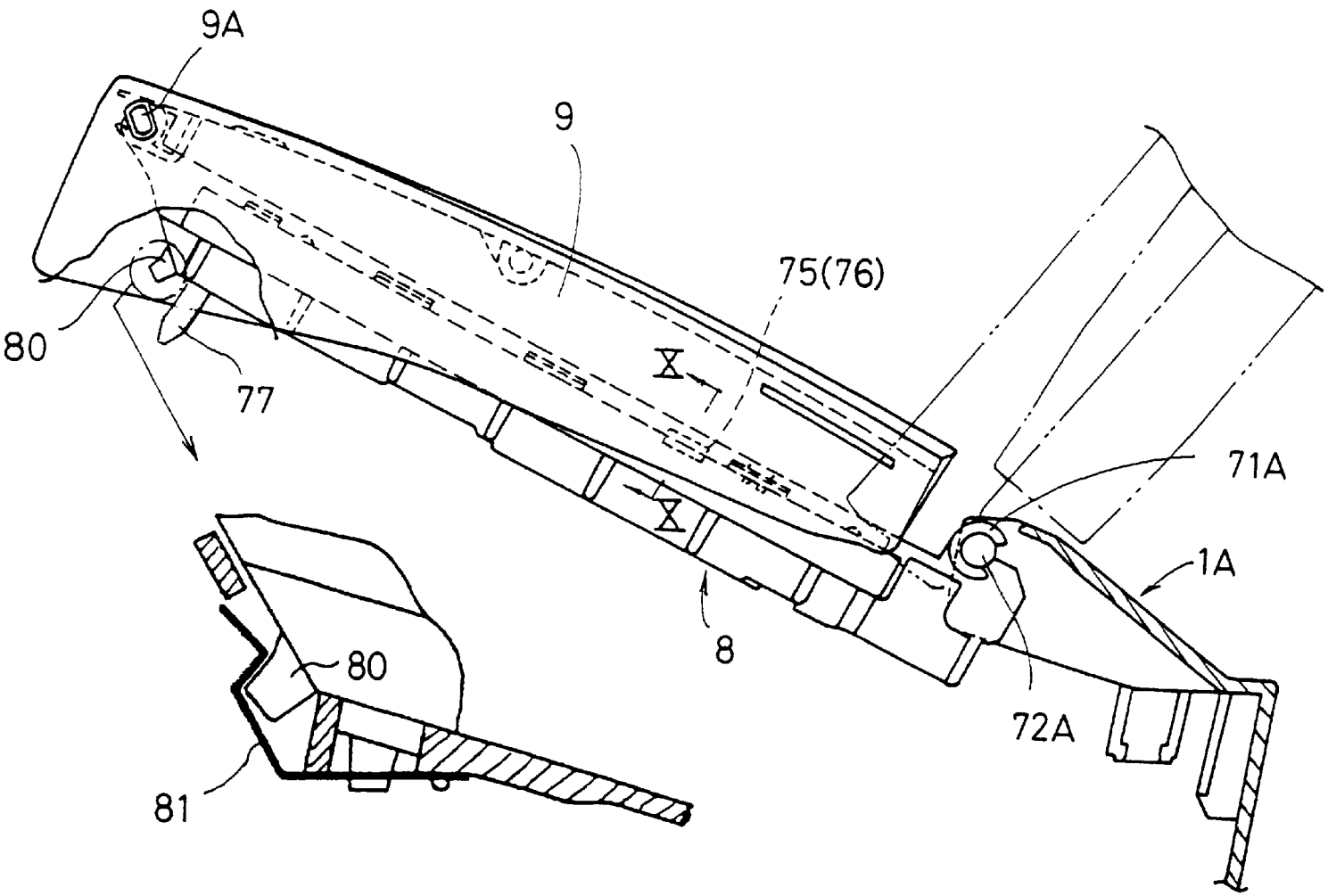
FIG. 6 is a side view of the attachments of the ink case.
Figure 7:
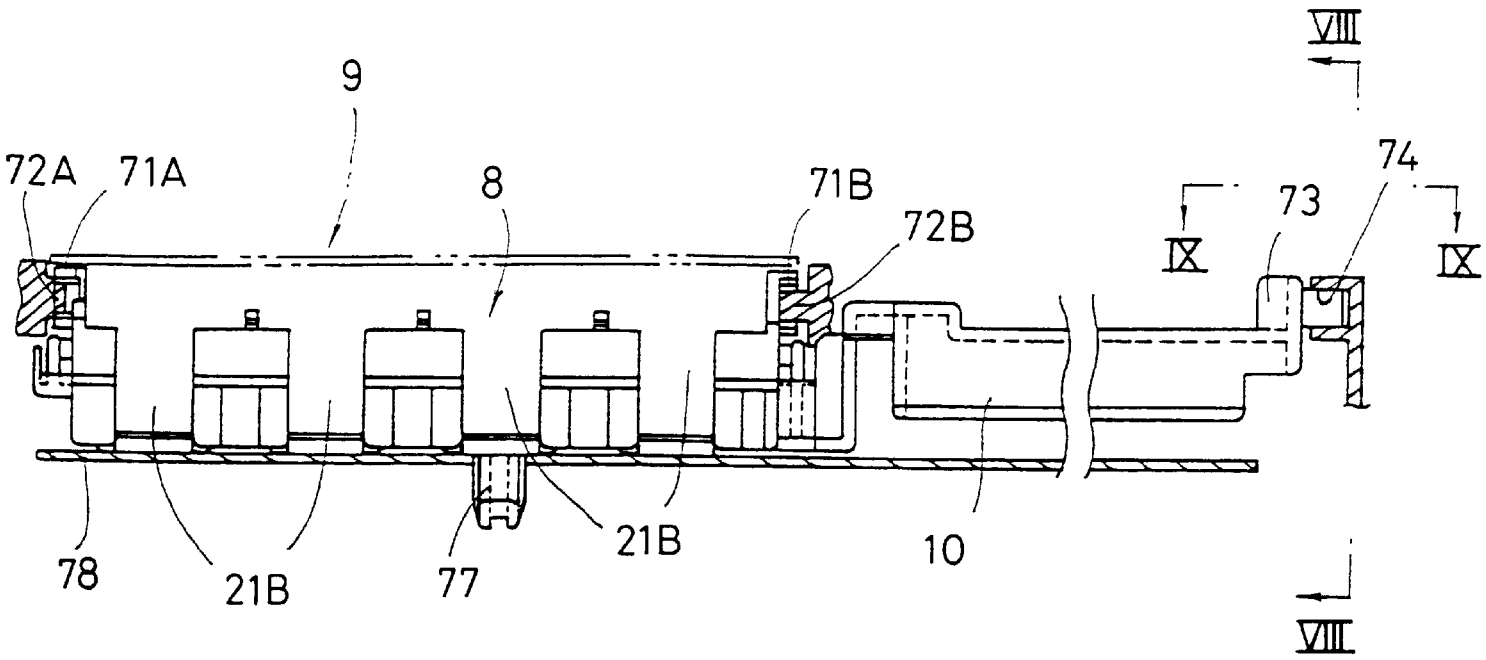
FIG. 7 is an enlarged view of arrows VII-to-VII in FIG. 1.

How the present invention was implemented is described below. FIG. 1 is a perspective view of the hot melt ink jet printer showing the features of the present invention. FIG. 2 is a side view of this printer. FIG. 3 is a schematic top view showing a switching mechanism of a clutch that produces the horizontal movement of a carriage 30. FIG. 4 is a top of the ink case. FIG. 5 is a side view of the ink case attachments to the main frame casing. FIG. 6 is a side view of the elements in the ink supplying section.

As shown in FIG. 1 and FIG. 2, a printer 1 includes a main frame casing 1A having freely moveable multiple paper feeder units 2 and 3 for setting cut paper sheets or transparent films for overhead projectors in a stack. As shown in FIG. 1, a control panel 4 with several switches for operation is provided on the top of the main frame casing 1A. In front of the main frame casing 1A, there is a paper ejection opening 5 from which paper P is ejected after being printed. The paper P ejected from the paper ejection opening 5 is stacked on a feeder output tray 6.

A central opening area 1B is formed on the top of the main frame casing 1A. This central opening area 1B forms a rectangle along the scan direction of a carriage 30. The central opening area 1B is usually covered by an inner cover 32 including an ink case 8, which is described later, and a cover body 10 which is so constructed as to be joined to one side of the ink case, and exposed by opening the inner cover 32.

The left side of the central opening area 1B is occupied by the ink case 8 in which ink pellets 22 for color ink jet printers, yellow (Y), magenta (M), cyan (C), and black (K) pellets are stored in rows, and the right side is covered by the side cover body 10. If the side cover body 10 is made of transparent or semitransparent material or plastic, the print operation condition can be observed without removing the side cover body 10. In addition, one or more ventilating holes 10A, e.g., vertical slits, are provided (drilled) on the side cover body 10. The ventilating holes 10A are provided for exhausting the hot air generated by print operation inside the printer 1.

A vertically pivotable outer cover body 7 is installed at the back of the main frame casing 1A. The bottom end 7A of the outer cover body 7 is attached to the main frame casing 1A. By pivoting the outer cover body 7 on its bottom end 7A, the top surface of the central opening area 1B except for the top surface of the ink case 8 can be covered. The top surface of the ink case 8 is covered by a case cover 9 which can be opened and closed.

Printing is performed in the condition that the case cover 9, the inner cover 32 (including the ink case 8 and the side cover body 10) and the outer cover body 7 are all closed.

At the bottom end of the paper feeder units 2 and 3, as shown in FIG. 2, half moon shaped paper feeder rollers 11A and 11B are located respectively to send the paper P stacked on the paper feeder units 2 and 3 or the manually inserted paper P from manual paper inserting trays 2A and 3A provided on the top of the paper feeder units 2 and 3 to a paper carrying passage. Along the paper carrying passage, couples of resist rollers 13A and 13B, a preheat platen 14, paper carrying rollers 15 with their pinch rollers 15A, a main platen 16, a cooling platen 17, paper ejecting rollers 18 with their pinch rollers 18A, the paper ejection opening 5, and the feeder output tray 6 are arranged in this order. The paper P moved along the paper carrying passage is heated from its back side by heaters (not shown) located on the preheat platen 14 and the main platen 16. Hot melt ink gushed out from a nozzle head facing the surface of the main platen 16 adheres to the surface of the paper P. Because the hot melt ink on the paper P solidifies by air cooling until the paper P has been carried to the paper ejecting rollers 18, the ink does not transfer to the surface of the paper ejecting rollers 18 and their pinch rollers 18A. In this way, the paper P on which print has been completed is ejected through the paper ejection opening 5 to the feeder output tray 6.

As shown in FIG. 2 and FIG. 3, a recording head 19 (including a nozzle head and melting hoppers 20, each of which has a heating unit, a molten ink tank and a heater) is mounted on the carriage 30. The carriage 30 is assembled so that it can move in its main scan direction indicated by arrows B and C through a run mechanism, which is not shown, and along a guide shaft 31 and guide rails. This main scan direction is perpendicular to the direction indicated by arrow A, in which paper P is carried. Although not shown in FIG. 3, an ink supplying section 33 (see FIG. 5) to supply ink pellets 22 in the ink case 8 to the melting hoppers 20 is located on the left end of the carriage, and a maintenance acting section 34 to cause the intermittent run of roll paper (not shown) for receiving the ink discharged from the nozzle head 12 for nozzle cleaning purposes is located on the right end of the carriage.

The above-mentioned hot melt ink is a generic term of ink that solidifies at normal temperature and liquefies when heated; e.g., it has the properties that its softening point is 40° C. to 140° C., melting point is 50° C. to 150° C., and viscosity when it is discharged from the nozzle is 3 to 50 CPS. Desirably, it contains 30 to 90% of wax, 5 to 70% of resin, 0.1 to 10% of a coloring agent, and other additives (such as a thickening agent, surface active agent, and dissolution active agent). Solid ink pellets 22 can be shaped in a downward "convex" form, that is, the width of a pellet is long in its upper half and short in its lower half and the sides of the pellet are stepped.

Next, the structure of the ink case 8 is described.

As shown in FIG. 4 to FIG. 10, on the rear end of the ink case 8, a base end axle 9A of the case cover 9, on which the case cover 9 can pivot, is installed. Furthermore, on the ink case 8, four long grooves 21 for storing yellow (Y), magenta (M), cyan (C), and block (K) ink pellets 22 respectively are located in parallel, sloping from the case cover 9 mounting end down to the free end of the ink case (toward the front of the main frame casing 1A). In the grooves 21, near the case cover 9 mounting end, there are pellet setting openings 21A which function as the inlets to supplement ink pellets 22 from cartridges in which multiple ink pellets 22 are stored. On the free end of the ink case 8, there are vertically opened outlets 21B to allow ink pellets to drop into the melting hoppers 20, so that ink pellets 22 in the ink case 8 can be supplemented if ink runs short.

These four ink pellet outlets 21B are located toward the front of the main frame casing 1A and at given intervals along the scan direction of the carriage 30. All ink pellets 22 are inserted into the grooves 21 so they can move to the outlets 21B with their steps on the sides supported by both edges of each groove. The ink pellets 22 are inserted into the grooves 21 so they can move forward and backward, and press-out blocks 24 biased by spiral springs 24A push the back of the ink pellets 22 toward the outlets 21B. Furthermore, a link body 25 causes all press-out blocks 24 to return toward the pellet setting openings 21A when the case cover 9 is opened.

As shown in FIG. 4 and FIGS. 6–10, fit-to-attachments 71A and 71B shaped such that part of the outer circumference of the ring is open are provided on both sides of the front of the ink case 8. A pin attachment 73 (FIG. 7) is provided on the right end of the side cover 10. These three attachments are positioned on the same axial line. The fit-to-attachments 71A and 71B are installed on lateral pins 72A and 72B provided on the main frame casing 1A respectively, allowing for pivotable motion. The pin attachment 73 is installed on a fit-to-attachment having a partial notch 74 on the main frame casing 1A, allowing for pivotable motion. By making the ink case 8 pivot counterclockwise from the position shown in FIG. 6, the fit-to-attachments 71A and 71B are detached from the lateral pins 72A and 72B, and the ink case 8 (and the side cover body 10) can be pivoted away from the main frame casing 1A.

To prevent the case cover 9 from being detached unintentionally from the ink case 8 when the ink case 8 pivots in the direction indicated by the two-dot chained line in FIG. 6, the ink case 8 and the case cover 9 are so constructed that bosses 75 provided on the inner surfaces of the downward sides 9B of the case cover 9 elastically engage and disengage with mating recesses 76 on the outer sides of the ink case 8.

Figure 8:
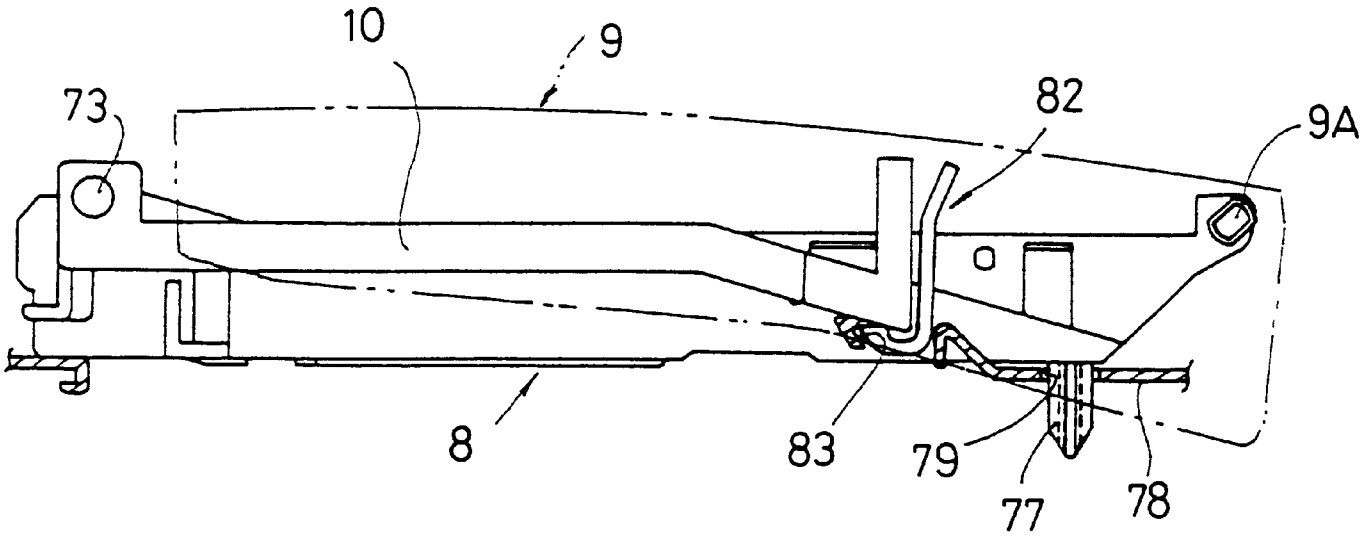
FIG. 8 is a view of arrows VIII-to-VIII in FIG. 7.
Figure 9:
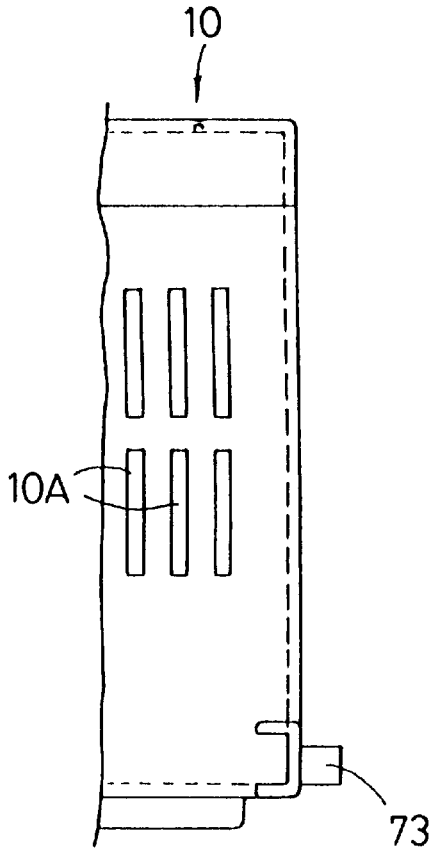
FIG. 9 is a plan view of a partial notch of the side cover, represented in arrows IX-to-IX in FIG. 7.
Figure 10:
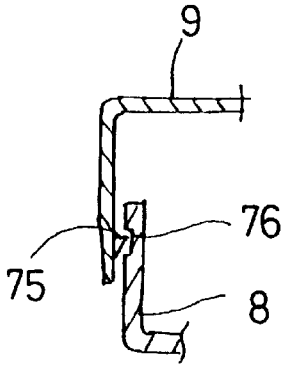
FIG. 10 is an enlarged cross section of arrows X-to-X in FIG. 6.

As shown in FIG. 8, a positioning projection 77 which is provided on the bottom surface of the ink case 8 and protrudes downward, fits into a positioning hole 79 drilled on a metal plate frame 78 located on the bottom surface of the main frame casing 1A when one side of the central opening area 1B is closed by the ink case 9 and prevents the ink case from being out of position. Furthermore, as shown in FIG. 6, a boss 80 provided on the rear end of the bottom surface of the ink case 8 is caught by its mating piece 81 made of a spring plate and provided on the frame 78, preventing the shaky motion of the ink case 8. In addition, an elastic locking piece 82 provided on the back surface of the side cover body 10 is assembled so it can elastically engage and disengage with a catch 83 provided in place on the frame 78. By the operation of this locking piece 82, the inner cover 32, in other words, the assembly of the ink case 8 and the side cover body 10, can be opened.

As shown in FIG. 5, an ink supplying section 33 is located at the outlets 21B in the ink case 8 to supply ink pellets 22 to the melting hoppers 20 through the outlets 21B. A clutch 35, as shown in FIG. 3, is located in the section of power transmission to a pellet emission mechanism 52 in the ink supplying section 33. In this structure, the revolving power from a driving motor 38 which can rotate either normally or reversely is transmitted to one end, positioned upstream, of the power transmission section in the clutch 35 via a timing belt 40 and one rotary shaft 39. Meanwhile, such a mechanism is provided so that, as the carriage 30 moves toward the ink supplying section, the clutch 35 is set in the power connection state, and, as the carriage 30 moves away from the ink supply section, the clutch 35 is set in the power disconnection state.

This mechanism is described below, based on FIG. 3. The revolving power from the driving motor 38 is transmitted through the timing belt 40, a gear 41 placed in the middle of the rotary shaft 39, a gear 42A of the set of gears 42 and to a gear 35B of a driving clutch body 35A. When the driving clutch body 35A moves in either of the directions indicated by arrows B and C, the gear 35B always meshes with the gears 42.

In a toggle lever 47 that can pivot on the core axis and provides switchover means, its arm and a shift lever 43 are coupled via the top of a connecting rod 43A and the lower end of the connecting rod 43A is coupled to the shift ring of the driving clutch body 35A. When a striking piece 43B protruding upward at the left end of the shift lever 43 is not pressed by a press-out piece 30A protruding from the carriage 30, that is, the arm of the toggle lever is in a position of pivoting clockwise, the load stressed by the compressing spring acts to keep this position and keep the driving clutch body 35A apart from a driven clutch body 35C with the in-between connecting rod 43A (in the state that the driving force is disconnected). Conversely, when the striking piece 43B of the shift lever 43 is pressed by the press-out piece 30A of the carriage 30 and moves in the arrow B direction by a given distance, that is, the toggle lever 47 is pivoting counterclockwise as in FIG. 3, the driving clutch body 35A and the driven clutch body 35C are engaged via the connecting rod 43A and the switchover to the power transmission state occurs. When the carriage 30 with the press-out piece 30A moves in the arrow C direction, the return to the power disconnection position can be carried out by a kick body 50 that causes the toggle lever 47 to pivot clockwise when pressed by the press-out piece 30A.

Then, a mechanism for supplying ink is described below, based on FIG. 5.

When the clutch 35 is set in the power connection state, the ON (standby state) of a limit switch 51A is confirmed and the reverse run of the driving motor 38 is started. After detection that the limit switch 51A has been turned OFF, the driving motor 38 is further rotated in the reverse direction by a required number of pulses and a spiral cam 51 assembled to be rotated coaxial with the driven clutch body 35C is rotated clockwise, as shown in FIG. 5, by a required angle (e.g., less than one turn). Then, the driving motor 38 is rotated in the forward (normal) direction by the same number of pulses as when rotated in the reverse direction to turn the limit switch 51A is turned ON. When the ON state of the limit switch is detected, the driving motor is rotated in the forward (normal) direction for a specified number of (minute or small) pulses, stopped, and is therefore in the standby state. In this way, the cam 51 rotates and returns over a given distance in compliance with the forward (normal) and reverse rotation of the driving motor 38, so that a pivoting lever 53, biased upward and located in the pellet ejection mechanism 52, will pivot up and down in a single reciprocating motion.

As shown in FIG. 5, in the positions corresponding to all outlets 21B (four in this example) of the ink case 8, four sets of press-out bodies 61 to push ink pellets 22 down, links 62 including two rods each having one end attached to the bottom end of each press-out body 61, and hook-like shaped lock/release bodies 58 which are selectively locked to and released from pins 62A on the lower end of the links 62 are located between a vertical frame 56 and a lid frame 59. On the other hand, long horizontal upper end axes 54A put across and supported on the upper ends of connecting arms 54, lower ends of which are coupled to the pivoting lever 53 which pivots forcibly by the cam 51, are inserted into the root of the four lock/release bodies respectively, allowing for pivotal motion. Rotary pinion gears 55 provided on both ends of each upper end axis 54A engage with racks 57 formed on the surface of the vertical frame 56. When one upper end axis 54A moves up and down between the vertical frame 56 and the lid frame 59, four lock/release bodies 58 move up and down together.

In the axis support section on the upper end of the vertical frame 56, the lower rear ends of each press-out body 61 are placed on a horizontal axis 63 which allows for vertical pivotal motion, but each press-out body 61 can be removed freely. Four guide holes 65 drilled on the vertical frame 56 are located so the lower ends of the links 62 and the lock/release bodies can properly be engaged and disengaged. Each lock/release body 58 is stressed by a compressing leaf spring 66 installed on the lid frame 59 so it will be oriented toward the back surface of the carriage 30 and located so a slide contact body 58A protruding upward from its base will always slide in contact with the surface of a plane plate 56A of the vertical frame 56. Therefore, each lock/release body 58 can remain in almost upright posture.

In addition, four selective control members 67, the number of which may vary according to the number of melting hoppers, are located in back of the carriage 30. The spacings of the four selective control members 67 are different from the spacings of the four lock/release bodies 58. By this setup, any of the selective control members 67 can slide in contact with the back surface of the associated lock/release body 58 when the carriage 30 stops in a selected position during moving in the arrow B or arrow C direction. Thus, when the descending lock/release body 58 slides in contact with the selective control member 67, it goes down while pivoting clockwise, as in FIG. 5, overcoming the spring force by the compressing leaf spring 66. Then, the lock/release body 58 engages with the pin 62A on the lower end of the link 62 and the link 62 also moves down as it descends, and at the same time, the corresponding press-out body 61 pivots downward on the horizontal axis 63. Eventually, at a specific outlet 21B, the press-out body 61 pushes an ink pellet 22 out, the bottom of which is supported by an elastic support piece 68, toward the associated melting hopper 20. Other lock/release bodies, on the back surface of which selective control members 68 do not slide, descend, remaining in its almost upright posture. Because they do not engage with pins 62A in corresponding places, the associated press-out bodies 61 do not pivot downward and therefore ink pellets 22 in corresponding places are not ejected from their outlets 21B.

Based on the internal structure of the printer described above, when the remaining amount of hot melt ink of a specific color in the melting ink tank becomes scanty as the print operation is carried out and the ink is consumed and a sensor, which is not shown, senses that the ink runs short, the carriage 30 moves toward the ink supplying section 33, that is, in the arrow B direction, as mentioned above. In conjunction with this carriage movement, the press-out piece 30A pushes left the striking piece 43A of the shift lever 43 and the toggle lever 47 turns counterclockwise to set and keep the clutch 35 in the power transmission state. Then, the carriage 30 moves in the arrow C direction in a given range (the kick body 50 is kicked right by the press-out piece 30A, but the toggle lever does not turn clockwise), so that a melting hopper 20 associated with the color of the ink that runs short will be positioned directly under the outlet 21B in the section in which ink pellets 22 of that color are stored. At this time, the appropriate selective control member 67 and the appropriate lock/release body 58 match in the ink pellet ejection mechanism 52. In this state, the driving motor 38 rotates reversely, as mentioned above, and the pivoting lever 53 goes up and down in only one reciprocating motion, so that one ink pellet 22 of the specific color can drop into the melting hopper 20.

To supplement ink pellets 22 to the ink case 8, as shown in FIG. 4, open only the case cover 9 and set a new ink holder 23 of a specific color, then ink pellets 22 of that color can be supplied through the setting opening 21A. By using ink holders 23, the user need not touch ink pellets 22, so there is no possibility of the transfer of fat or dirt on hands to ink pellets 22. Thus, the quality of ink can be maintained.

On the other hand, if a paper jam occurs during a print operation, first open the outer cover 7 and lift the inner cover 32. The assembly of the ink case 8 and the side cover body 10 is controllable by holding the elastic locking piece 82 with your fingers. Then, open the central opening 1B widely and you may remove the jammed paper P. Thus, it is quite easy to make recovery from paper jam.

The invention has been described with reference to preferred embodiments thereof, which are intended to be illustrative, not limiting. Various changes, modifications and other contributions of the disclosed arrangements are within the spirit and scope of the invention.

What is claimed is:

1. A hot melt ink jet printer, comprising:

a main frame casing including:

a recording head that ejects hot melt ink to a surface of a medium onto which images are printed;

a carriage mounting the recording head, the carriage being driven in a scan direction perpendicular to a feed direction of the medium; and an ink supplying section that supplies ink pellets to the recording head, the ink supplying section being positioned on one end of the scan direction;

an opening area provided on a top surface of the main frame casing; and a lid system that selectively covers the opening area, the lid system including an ink case positioned over the ink supplying section, and a side cover body positioned adjacent one side of the ink case, wherein the ink case is lifted together with the side cover body in conjunction with the side cover body being opened, and the opening area is exposed by operation of opening the side cover body.

2. The hot melt ink jet printer according to claim 1, wherein said lid system includes attachments that selectively engage with the main frame casing, a positioning system that positions the ink case with respect to the main frame casing when said opening area is closed, and a lock/release system that selectively attaches the lid system to the main frame casing.

3. The hot melt ink jet printer according to claim 2, further comprising:

an ink pellet supplementing opening provided on a top surface of said ink case;

an ink case cover covering at least said ink pellet supplementing opening, the ink case cover being pivotably connected to the ink case about a pivoting point positioned opposite to a point of attachment between said main frame casing and the ink case; and a releasable lock provided between the ink cover and the ink case.

4. The hot melt ink jet printer according to claim 3, further comprising:

at least one ink pellet hopper provided on said carriage; and ink ejection sections provided on said ink case and arranged along said scan direction to eject ink pellets of different colors separately to each said at least one hopper on said carriage, wherein the ink case is located on an upper position of said main frame casing while said ejection sections are placed in a lower position of said main frame casing.

5. The hot melt ink jet printer according to claim 1, further comprising:

at least one ink pellet hopper provided on said carriage; and ink ejection sections provided on said ink case and arranged along said scan direction to eject ink pellets of different colors separately to said at least one hopper on said carriage, wherein the ink case is located on an upper position of said main frame casing while said ejection sections are placed in a lower position of said main frame casing.

6. The hot melt ink jet printer according to claim 5, wherein at least a portion of said lid system comprises a transparent or semitransparent material.

7. The hot melt ink jet printer according to claim 6, wherein said ink case and the side cover body are formed together in an integral construction.

8. The hot melt ink jet printer according to claim 1, wherein at least a portion of said lid system comprises a transparent or semitransparent material.

9. The hot melt ink jet printer according to claim 8, wherein said ink case and the side cover body are formed together in an integral construction.

10. An ink jet printers comprising:

a recording head that ejects ink to a surface of a medium onto which images are printed;

an ink supply section that supplies ink to [said] the recording head;

a paper conveyor system that transports the medium past the ink recording head;

an opening area provided in a main frame casing above the ink supply section and the paper conveyor system;

an ink case positioned over the ink supplying section; and a side cover body positioned over the paper conveyor system and adjacent the ink case, wherein the ink case is lifted together with the side cover body in conjunction with the side cover body being opened, and the opening area is exposed by operation of opening the side cover body.

11. The ink jet printer according to claim 10, further comprising an ink case cover pivotably connected to the main frame casing to cover the ink case.

12. The ink jet printer according to claim 11, wherein the ink case cover and the ink case are hinged on opposite sides from one another.

13. The ink jet printer according to claim 12, wherein the side cover body and the ink case are hinged about substantially the same axis.

14. The ink jet printer according to claim 1, further comprising a boss of the ink case cover that releasably mates with a recess of the ink case.

15. The ink jet printer according to claim 11, further comprising an outer cover body that covers the side cover body.

16. The ink jet printer according to claim 10, further comprising an elastic lock attached to the side cover body to control opening of the side cover body and the ink case.

17. The ink jet printer according to claim 10, wherein the side cover body is made of transparent or semitransparent material.

18. The ink jet printer according to claim 10, further comprising a carriage mounting the recording head, the carriage being driven in a scan direction perpendicular to a feed direction of said medium.

19. The ink jet printer according to claim 18, further comprising:

at least one ink pellet hopper provided on said carriage; and ink ejection sections provided on said ink case and arranged along said scan direction to eject ink pellets of different colors separately to each said hopper on said carriage, wherein the ink case is located on an upper position of said main frame casing while said ejection sections are placed in a lower position of said main frame casing.

20. The ink jet printer according to claim 19, further comprising:

an ink pellet supplementing opening provided on a top surface of said ink case;

an ink case cover covering at least said ink pellet supplementing opening, the ink case cover being pivotably connected to the ink case about a pivoting point positioned opposite to a point of attachment between said main frame casing and the ink case; and a releasable lock provided between the ink case cover and the ink case.

* * * * *